US005714301A

United States Patent [19]

Boroson et al.

[11] Patent Number: 5,714,301

[45] Date of Patent: Feb. 3, 1998

[54] SPACING A DONOR AND A RECEIVER FOR COLOR TRANSFER

[75] Inventors: Michael L. Boroson, Rochester; Charles D. DeBoer, Palmyra; Kathleen S. Hollis, Dalton, all of N.Y.

[73] Assignee: Eastman Kodak Company, Rochester, N.Y.

[21] Appl. No.: 738,508

[22] Filed: Oct. 24, 1996

[51] Int. Cl.[6] ..... G03C 5/00

[52] U.S. Cl. ..... 430/201; 430/7; 430/945; 503/227

[58] Field of Search ..... 430/200, 201, 430/945, 964, 7; 503/227

[56] References Cited

U.S. PATENT DOCUMENTS

| | | | |
|---|---|---|---|
| 4,541,830 | 9/1985 | Hotta et al. | 8/471 |
| 4,621,271 | 11/1986 | Brownstein | 346/76 |
| 4,695,287 | 9/1987 | Evans et al. | 8/471 |
| 4,695,288 | 9/1987 | Ducharme | 8/471 |
| 4,698,651 | 10/1987 | Moore et al. | 503/227 |
| 4,700,207 | 10/1987 | Vanier et al. | 503/227 |
| 4,701,439 | 10/1987 | Weaver et al. | 503/227 |
| 4,737,486 | 4/1988 | Henzel | 503/227 |
| 4,743,463 | 5/1988 | Ronn et al. | 427/53.1 |
| 4,743,582 | 5/1988 | Evans et al. | 503/227 |
| 4,753,922 | 6/1988 | Byers et al. | 503/227 |
| 4,757,046 | 7/1988 | Byers et al. | 503/227 |
| 4,769,360 | 9/1988 | Evans et al. | 503/227 |
| 4,772,582 | 9/1988 | DeBoer | 503/227 |
| 4,876,235 | 10/1989 | DeBoer | 503/227 |
| 4,912,083 | 3/1990 | Chapman et al. | 503/227 |
| 4,923,860 | 5/1990 | Simons | 503/227 |
| 4,942,141 | 7/1990 | DeBoer et al. | 503/227 |
| 4,948,776 | 8/1990 | Evans et al. | 503/227 |
| 4,948,777 | 8/1990 | Evans et al. | 503/227 |
| 4,948,778 | 8/1990 | DeBoer | 503/227 |
| 4,950,639 | 8/1990 | DeBoer et al. | 503/227 |
| 4,950,640 | 8/1990 | Evans et al. | 503/227 |
| 4,952,552 | 8/1990 | Chapman et al. | 503/227 |
| 4,973,572 | 11/1990 | DeBoer | 503/227 |
| 5,036,040 | 7/1991 | Chapman et al. | 503/227 |
| 5,126,760 | 6/1992 | DeBoer | 346/108 |
| 5,168,288 | 12/1992 | Baek et al. | 346/76 |
| 5,229,232 | 7/1993 | Longobardi et al. | 430/7 |
| 5,254,524 | 10/1993 | Guittard et al. | 430/200 |
| 5,291,218 | 3/1994 | DeBoer | 503/227 |
| 5,342,817 | 8/1994 | Sarraf | 430/201 |
| 5,378,676 | 1/1995 | Defieuw et al. | 503/227 |

FOREIGN PATENT DOCUMENTS 2083726 3/1982 United Kingdom .

*Primary Examiner*—John A. McPherson
*Attorney, Agent, or Firm*—Raymond L. Owens

[57] ABSTRACT

A method of producing a radiation-induced colorant transfer image on a support, includes the steps of: providing an image-receiving element comprising a support having thereon an image-receiving layer; providing a colorant donor element having a colorant transfer layer on a colorant element support and wherein colorant can be transferred from a transfer surface of the colorant donor element to the image-receiving element in response to selectively applied radiation, the colorant element support being configured to provide a surface having peaks and valleys; pressing the colorant element support surface against a rigid element so as to cause the colorant transfer layer surface to conformally have peaks and valleys; causing the peaks of the colorant transfer layer to engage the image-receiving element; and applying radiation to the colorant donor element to cause colorant to transfer in the space between the image-receiving element and the colorant transfer layer surface corresponding to the valleys in the colorant transfer surface.

4 Claims, 4 Drawing Sheets

SPACING A DONOR AND A RECEIVER FOR COLOR TRANSFER

CROSS REFERENCE TO RELATED APPLICATION

Reference is made to commonly-assigned U.S. patent application Ser. No. 08/736,104 filed concurrently herewith, entitled "Spacing a Donor and a Receiver for Color Transfer" by Boroson et al, the teachings of which are incorporated herein by reference.

FIELD OF THE INVENTION

This invention relates to a method of controlling the spacing between a donor and receiver in a radiation-induced colorant transfer system.

BACKGROUND OF THE INVENTION

In recent years, radiation transfer systems have been developed to obtain prints from pictures which have been generated electronically from a color video camera; to obtain a color proof image before a printing press run is made; to form patterns on substrates for electronic, optical, and magnetic devices; and to form color filter arrays.

According to one way of obtaining prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Similar methods have been disclosed for obtaining color proofs. In U.S. Pat. No. 5,126,760 of DeBoer, the disclosure of which is hereby incorporated by reference, a thermal dye transfer process is described for producing a direct digital, halftone color proof of an original image. The proof is used to represent a printed color image obtained from a printing press.

In U.S. Pat. No. 4,743,463 of Ronn, et. al., the disclosure of which is hereby incorporated by reference, a method of forming patterns on a substrate or support is described. The method consists of using a laser beam to vaporize a layer of a specified pattern-forming material and to the deposit the pattern-forming material onto a substrate by moving the substrate and the laser beam relative to each other according to a predetermined pattern. This method is useful in forming elements comprising a metal or dye pattern on a substrate or a support, such as integrated circuits or color filter arrays.

One method to reduce the cost of color filter array manufacture while still maintaining the required quality is by use of radiation colorant transfer method as discussed in commonly-assigned U.S. Pat. No. 4,923,860, the disclosure of which is incorporated herein. In the method described therein, the color filter array is formed by transferring colorant to a polymer image-receiving layer on a transparent support from a colorant donor element by use of a mask and a high intensity light source. In such a system, the colorant donor element includes a material which strongly absorbs at the wavelength of the light source. When the colorant donor element is selectively irradiated, this absorbing material converts light energy to thermal energy and transfers the heat to the colorant transfer layer in the immediate vicinity, thereby transferring colorant from the transfer surface of the colorant donor element to the polymer image-receiving layer on the transparent support. The absorbing material may be present in a layer beneath the colorant transfer layer and/or it may be admixed with the colorant transfer layer.

Spacer beads may be employed in a separate layer over the colorant layer of the colorant donor element in the above described radiation processes in order to maintain a finite separation distance between the colorant donor element and the polymer image-receiving layer during colorant transfer. A finite separation distance is required to prevent sticking of the colorant donor element to the polymer image-receiving layer during colorant transfer, and also to increase the uniformity and density of the transferred image. That invention is more fully described in commonly-assigned U.S. Pat. No. 4,772,582, the disclosure of which is incorporated herein.

One problem with employing spacer beads in a separate layer over the colorant layer of the colorant donor element is that the coating of the spacer bead layer must not damage the colorant transfer layer. The coating of the spacer bead layer is therefore limited to solvents and binders that are incompatible with the colorant transfer layer and will not attack the colorant transfer layer. The result of the using incompatible solvents and binders for the spacer bead layer is that the spacers beads are not strongly attached to the colorant donor element. Missing beads can result in sticking between the donor and receiver, low density areas in the image, and decreased uniformity of the transferred image. Color filter arrays are produced in very low particulate cleanroom facilities to prevent dirt and particles from creating defects in the color filter arrays. Loose spacer beads from the colorant donor element would also prevent utilization of this method for producing color filter arrays.

Alternatively, spacer beads may be employed in the polymer image-receiving layer as described in commonly-assigned U.S. Pat. No. 4,876,235, the disclosure of which is incorporated herein. This patent indicates that a controlled space between the colorant donor element and the polymer image-receiving layer is required to obtain a good uniform image in radiation colorant transfer. If there is no space, two problems can occur during printing. First, the printing density may be very low, probably because direct contact with the polymer image-receiving layer draws much of the heat away from the colorant transfer layer creating a cool surface. Second, the colorant donor element and polymer image-receiving layer tend to stick together under the melting heat of the radiation. When separation is attempted, the colorant transfer layer is stripped from the colorant element support, destroying image discrimination by producing areas of very high density. These random alternating patches of very low and very high density make a highly mottled and unusable image. The solution to the problem described in U.S. Pat. No. 4,876,235 was to separate the colorant donor element and polymer image-receiving layer by means of matte beads coated in the polymer image-receiving layer. Because the matte beads are very small, 3 to 50 μm, they usually appear practically invisible to the eye in normal, unmagnified viewing.

One problem with matte beads as spacers within the imaging area of the polymer image-receiving layer is that they create tiny defects in the image that are visible when magnified, such as a 35 mm slide image which is magnified 25 times or more when projected onto a large screen. Another problem is the matte beads create a surface topography on the receiver element that would be unacceptable for glossy images and color filter arrays. For color proofing, the beads must be imbedded into the final image receiver by retransferring the image from an intermediate receiver to obtain the appropriate surface finish for the proof. Color filter arrays require surface roughness variations of less than 0.5 μm. Surface topography of 3 to 50 μm resulting from matte beads would eliminate the utility of color filter arrays made by this method.

It is desirable to improve the uniformity of the colorant image which is transferred by radiation, thereby resulting in improved colorant uniformity, without having matte bead defects or surface topography on the receiver and without requiting a retransfer process from an intermediate for producing radiation-induced colorant transfer images.

SUMMARY OF THE INVENTION

It is the object of this invention to provide a method of producing radiation-induced colorant transfer images with high colorant uniformity.

This object is achieved in a method for producing a radiation-induced colorant transfer image, comprising the steps of:

a) providing an image-receiving element comprising a support having thereon an image-receiving layer;

b) providing a colorant donor element having a colorant transfer layer on a colorant element support and wherein colorant can be transferred from a transfer surface of the colorant donor element to the image-receiving layer in response to selectively applied radiation, the colorant element support being configured to provide a surface having peaks and valleys;

c) pressing the colorant element support surface against a rigid element so as to cause the colorant transfer layer surface to conformally have peaks and valleys;

d) causing the peaks of the colorant transfer layer to engage the image-receiving element; and e) applying radiation to the colorant donor element support to cause colorant to transfer in the space between the image-receiving element and the colorant transfer layer surface corresponding to the valleys in the colorant transfer surface.

In accordance with the invention, it has been found preferable that the peaks have a height of about 3 to 50 μm above the valleys which are located on the back of the colorant donor support of about 6 to 100 μm thickness such that pressing the colorant donor element against the rigid element causes the colorant transfer layer surface to conformally have peaks and valleys; and the peaks which are engaged against the image-receiving element maintain a space between the colorant transfer layer and the image-receiving element without transferring particles to the radiation-induced colorant transfer image and without producing a surface variation on the radiation-induced colorant transfer image greater than 0.5 μm.

Advantages

Advantages of the present invention include providing an improved colorant uniformity without having matte bead defects or surface topography. Moreover, the present invention eliminates the need for a retransfer process from an intermediate.

DETAILED DESCRIPTION OF THE INVENTION

Figure 1A:
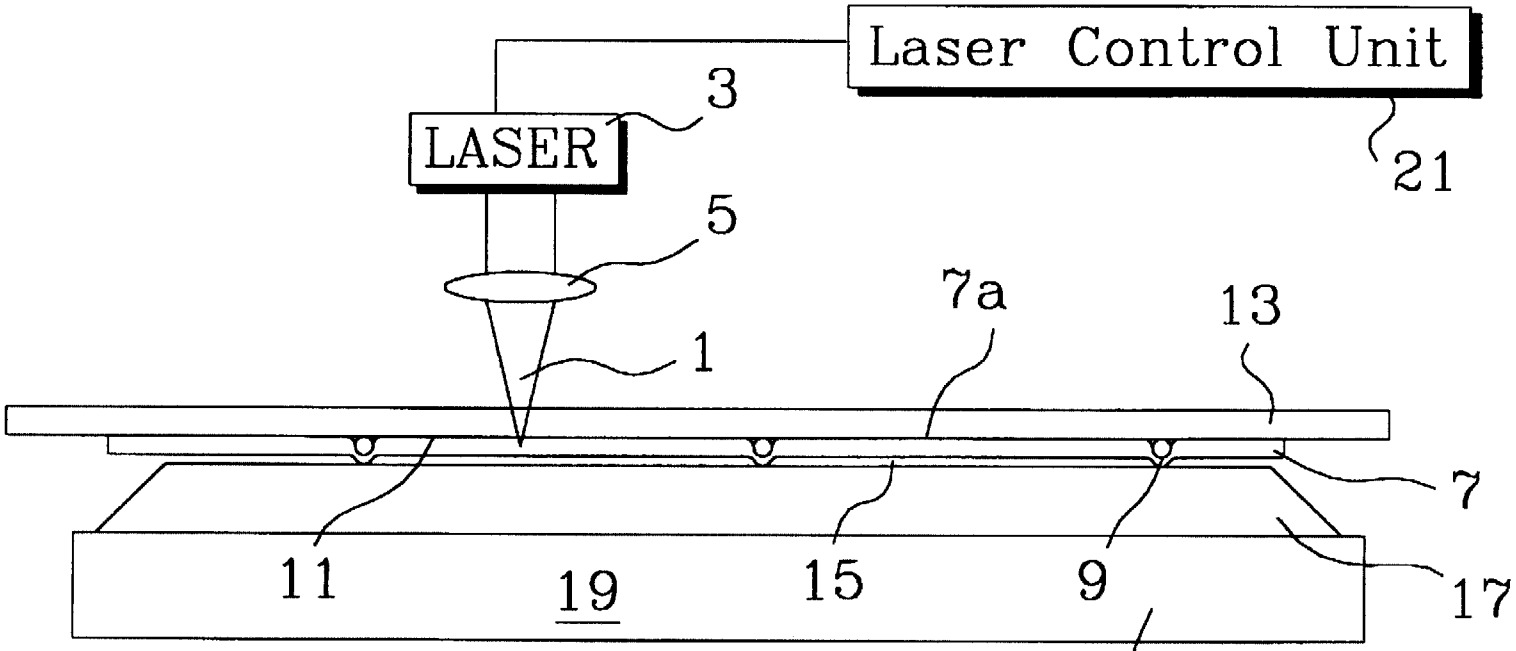
FIG. 1*a* shows in schematic form a step in the process of forming a radiation-induced colorant transfer image by using laser light and a transparent rigid element against which the colorant donor element is pressed.

Various methods can be used to transfer colorant from the colorant donor element to the image-receiving element to make the radiation-induced colorant transfer image of the invention. For example, a high intensity light flash from a xenon filled flash lamp can be used with a colorant donor element containing an energy absorptive material such as carbon black or a light-absorbing dye. This method is more fully described in commonly-assigned U.S. Pat. No. 4,923,860, the disclosure of which is incorporated herein by reference.

In another embodiment of the invention, the radiation is supplied by means of a laser, using a colorant donor element comprising a support having thereon a colorant transfer layer and an absorbing material for the wavelength of the laser.

To obtain the radiation-induced colorant transfer image employed in the invention, a diode laser is preferably employed since it offers substantial advantages in terms of its small size, low cost, stability, reliability, ruggedness, and ease of modulation. In practice, before any laser can be used to heat a colorant donor element, the element must contain an infrared-absorbing material, such as carbon black, cyanine infrared absorbing dyes as described in U.S. Pat. No. 4,973,572, or other materials as described in the following U.S. Pat. Nos. 4,948,777; 4,950,640; 4,950,639; 4,948,776; 4,948,778; 4,942,141; 4,952,552; 4,912,083; 4,942,141; 4,952,552; 5,036,040; and 4,912,083, the disclosures of which are hereby incorporated by reference. The laser radiation is then absorbed into the colorant layer and converted to heat by a molecular process known as internal conversion. Thus, the construction of a useful colorant layer will depend not only on the hue, transferability and intensity of the image colorants, but also on the ability of the colorant layer to absorb the radiation and convert it to heat. The infrared-absorbing material may be contained in the colorant layer itself or in a separate layer associated therewith.

Lasers which can be used to transfer colorant from colorant donor elements employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described in commonly assigned U.S. Pat. No. 5,168,288 of Baek and DeBoer, the disclosure of which is hereby incorporated by reference.

Any colorant can be used in the colorant donor element employed in the invention provided it is transferable to the image-receiving element by the action of the radiation. The colorants used in the invention may include pigments or dyes. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

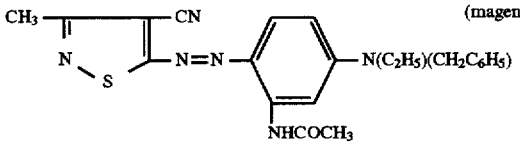
(magenta) M-1

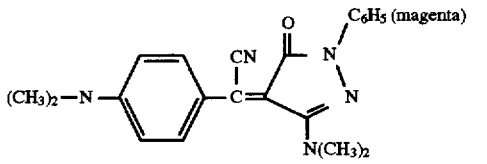
(magenta) M-2

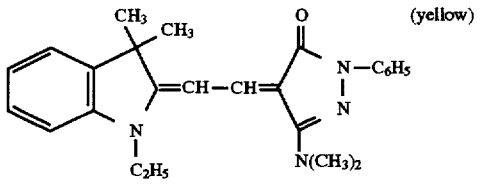
(yellow) Y-1

-continued

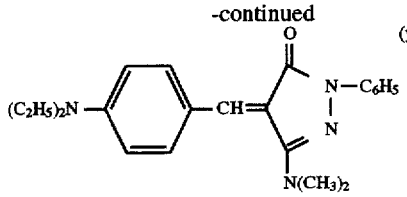
(yellow) Y-2

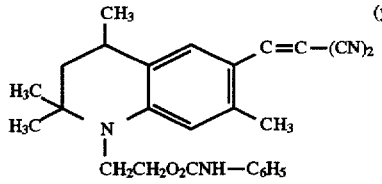
(yellow) Y-3

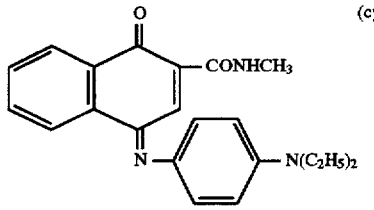
(cyan) C-1

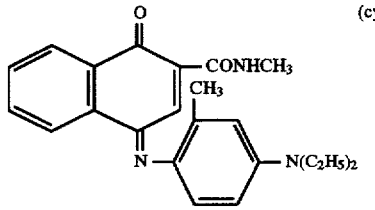
(cyan) C-2 or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The colorant in the colorant donor element employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The colorant transfer layer of the colorant donor element may be coated on the support or printed thereon by a printing technique such as a gravure process.

Any material can be used as the support for the colorant donor element employed in the invention provided it is dimensionally stable and can withstand the heat of the radiation. Such materials include polyesters such as poly (ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support may also be coated with a subbing layer, if desired, such as those materials described in U.S. Pat. Nos. 4,695,288 or 4,737,486.

The image-receiving element that is used with the colorant donor element employed in the invention generally comprises a support having thereon a polymer image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the image-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed. In another preferred embodiment, the image-receiver support may also be colorant-receptive so that a separate image-receiving layer is not required.

The image-receiving layer may comprise a polymer compatible with the colorant such as, for example, a polycarbonate, a polyurethane, a polyester, polyvinyl chloride, poly(styrene-co-acrylonitrile), poly(caprolactone) or mixtures thereof. The image-receiving layer may be present in any amount which is effective for the intended purpose. In general, good results have been obtained at a concentration of from about 1 to about 5 g/m$^2$.

In one embodiment of the invention, the radiation is supplied by means of a laser, using a colorant donor element comprising a support having thereon a colorant transfer layer and an absorbing material for the wavelength of the laser. FIG. 1*a* shows the practice of such an apparatus. In this arrangement, the light emission 1 of a laser 3 is focused by lens or optical system 5 onto a colorant donor element 7 which will be understood to include at least a support and a colorant transfer layer. Typically, such layers include an adhesion layer or a light-absorbing layer. The colorant donor element 7 has a transfer surface wherein colorant, such as dye, is transferred in response to selectively applied radiation to an image-receiving element 19*a* which will be understood to include at least an image-receiving support 19 and an image-receiving layer, typically a polymer image-receiving layer 17. Typically, such layers include an adhesion layer or a cushion layer. The rear surface 7*a* of the colorant donor element 7 is configured to provide peaks 9 and valleys 11 as will be discussed later. For clarity of illustration the peaks 9 have been exaggerated and so are not to scale. The colorant donor element 7 has peaks 9 and valleys 11 arranged such that pressing the colorant donor element against a transparent rigid element 13 provides a space 15 between the colorant donor element 7 and the polymer image-receiving layer 17. The intensity and movement of the laser 3, transparent rigid element 13, colorant donor element 7, and image-receiving element 19*a* is controlled by a laser control unit 21 in such a manner as to produce colorant in the appropriate location.

Figure 1B:
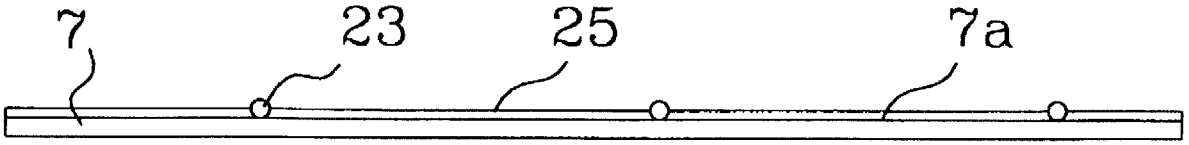
FIG. 1*b* shows a cross-section of the colorant donor element from FIG. 1*a;*

FIG. 1*b* shows a cross-section of an embodiment of a colorant donor element 7 showing its peaks and valleys. The colorant donor element 7 is coated on the back of the colorant donor support with a mixture of organic or inorganic beads 23 forming the peaks 9 shown in FIG. 1*a* and in a binder 25. Other methods for forming peaks and valleys on the colorant donor element 7 include, but are not limited to, mechanically roughening the colorant donor support, embossing the colorant donor support, printing a raised pattern on the colorant donor support, or coating a mixture of irregular particles or fibers and a binder on the colorant donor support. The method of forming the peaks and valleys on the colorant donor element is not critical to the invention, but the height and frequency of the peaks and the conformability of the colorant donor support are critical. Peaks of about 3 to 50 μm height above the rear surface 7*a* and surface concentration in a range from about 0.1 to 100 peaks/mm$^2$ have been found to be advantageous. In a preferred embodiment, peaks of about 3 to 12 μm height and surface concentration in a range of from about 0.1 to 10 peaks/mm$^2$ are employed. Conformability of the colorant donor support is determined by material properties and support thickness. It has been found advantageous to have the colorant donor element support thickness to be in a range of about 6 to 100 μm. In a preferred embodiment, colorant donor support thickness of about 6 to 50 μm is employed.

Figure 2:
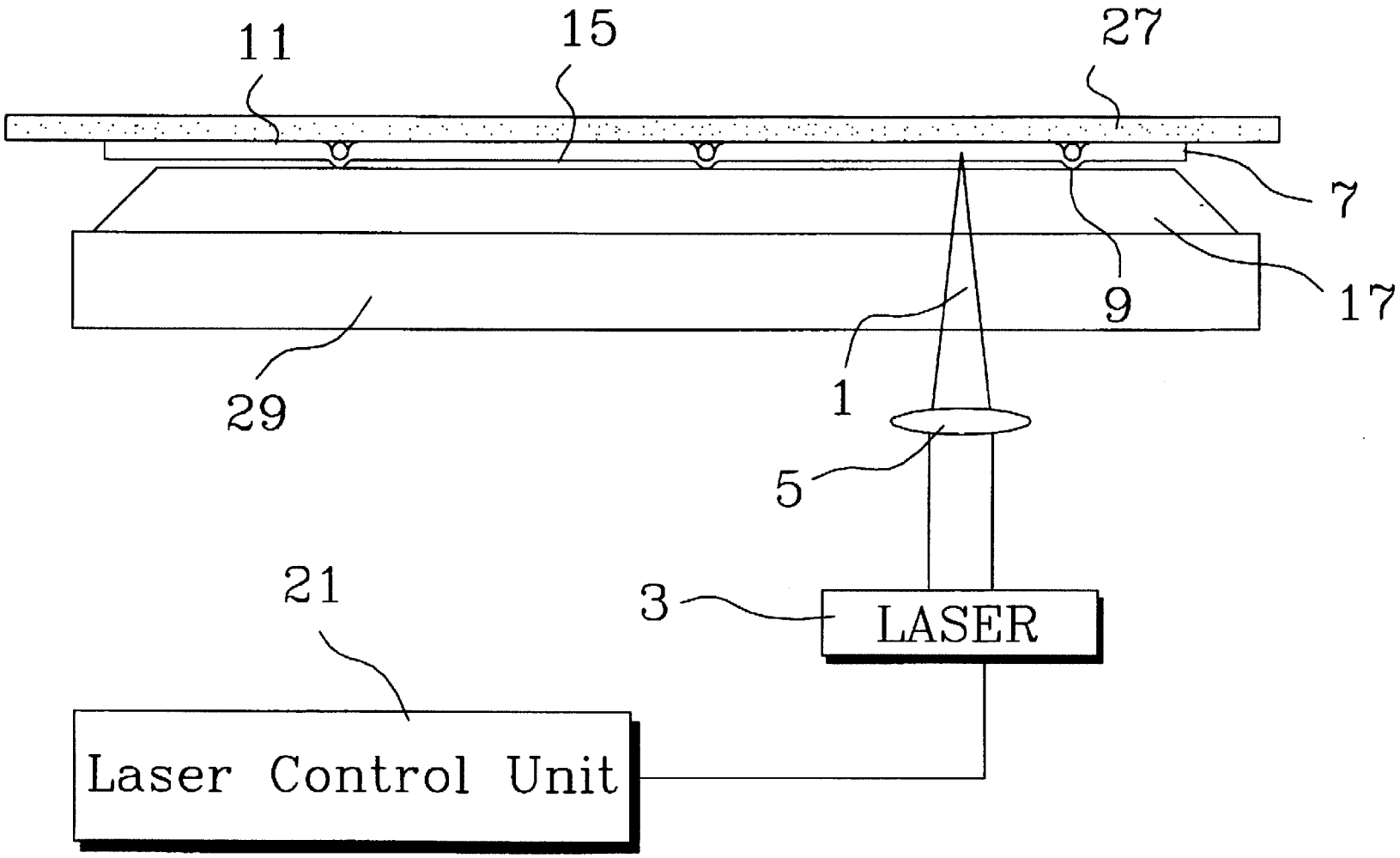
FIG. 2 shows in schematic form a step in the process of forming a radiation-induced colorant transfer image by using laser light and an opaque rigid element against which the colorant donor element is pressed.

In another embodiment of the invention shown in FIG. 2, the light emission 1 supplied by means of a laser 3 is directed through a transparent support 29 of the polymer image-receiving layer 17 and the colorant donor element 7 is pressed against an opaque rigid element 27. Hereinafter where elements correspond to those in FIGS. 1*a* and 1*b*, the same reference numerals will be used, since these elements have the same function as discussed above. In this arrangement, the light emission 1 of the laser 3 is focused by lens or optical system 5 onto the colorant donor element 7. The colorant donor element 7 has peaks 9 and valleys 11 arranged such that by pressing the colorant donor element 7 against the opaque rigid element 27 provides the space 15 between the colorant donor element 7 and the polymer image-receiving layer 17. The intensity and movement of the laser 3, image-receiving element 19*a*, colorant donor element 7, and opaque rigid element 27 is controlled by the laser control unit 21 in such a manner as to produce colorant in the appropriate location.

Figure 3:
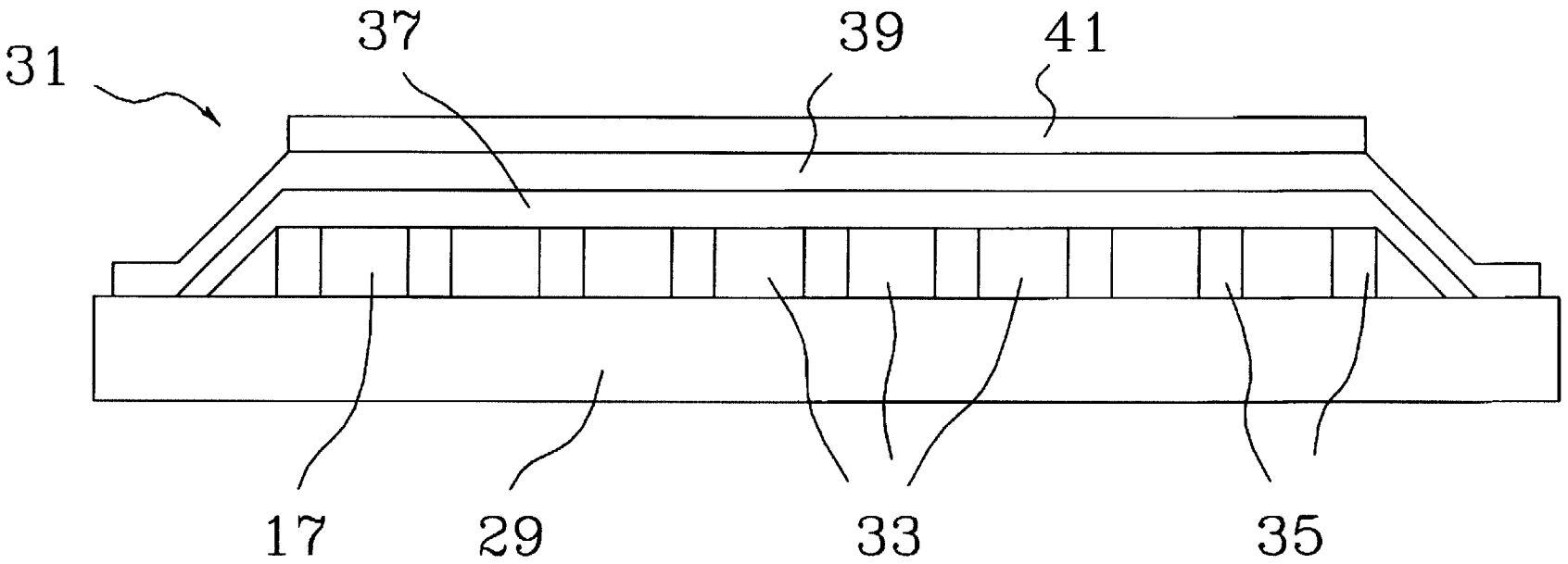
FIG. 3 is a cross-sectional view of a color filter array made in accordance with the present invention.

FIG. 3 shows a cross sectional schematic of a color filter array 31 made in accordance with the present invention which can be used in a liquid crystal display device (not shown). The color filter array 31 includes the transparent support 29 formed of glass, plastic, or other suitable material. The color filter array 31 includes red (R), green (G), and blue (13) color cells or pixels cells 33 embedded in the polymer-image receiving layer 17. It will be understood to those skilled in the art that other colors, such as cyan, magenta and yellow can also be used. Black grid lines 35 separate each color pixel. The color filter array 31 has a polymeric protective overcoat layer 37 and also can be coated with a transparent conducting layer 39. The transparent conducting layer 39 can be made of, for example, indium tin oxide (ITO). When used in a liquid crystal device (LCD) an alignment layer 41 is used.

Figure 4:
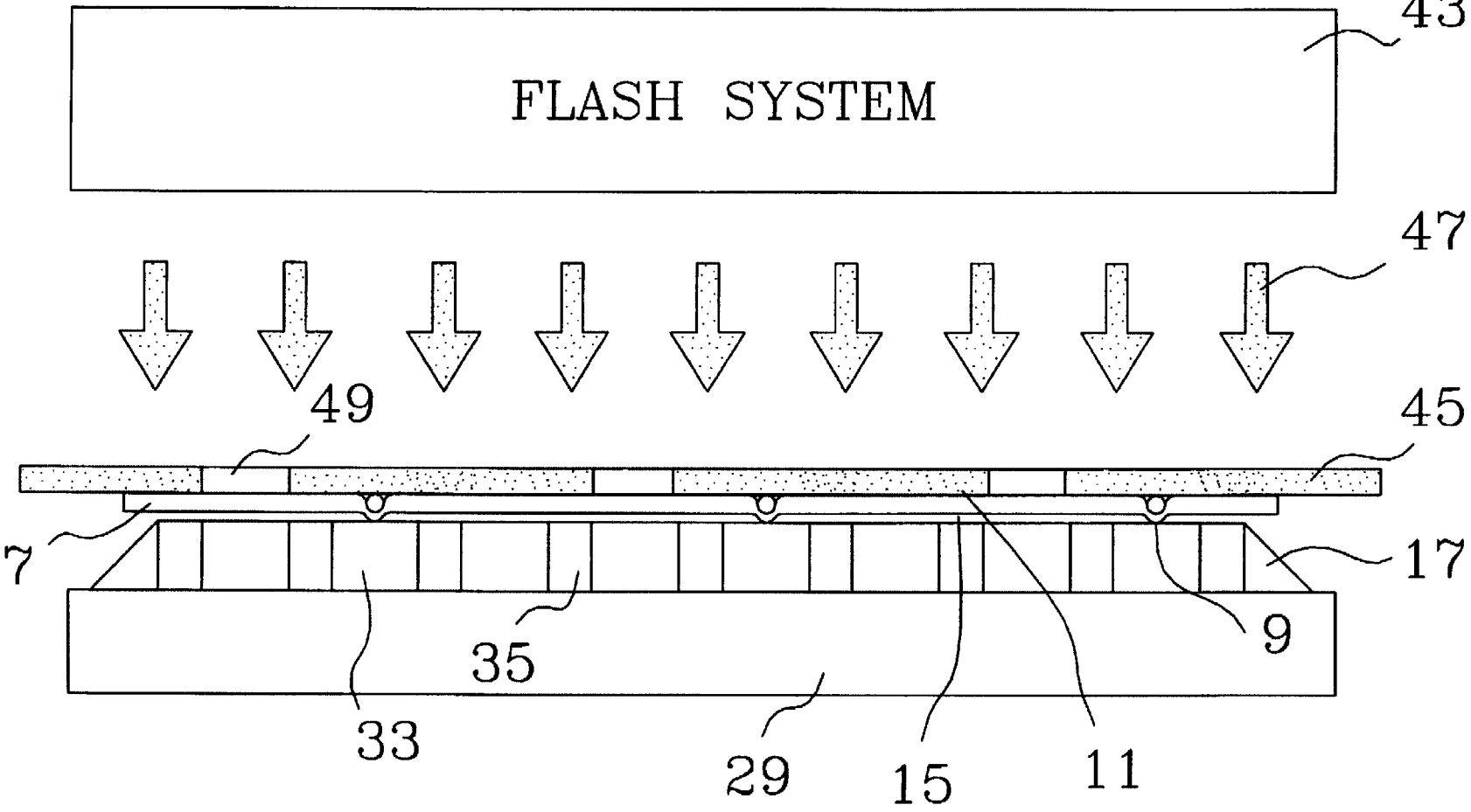
FIG. 4 shows a step in the process of making the color filter array of FIG. 3 wherein colored pixels are being formed in the polymer image-receiving layer.

FIG. 4 shows schematically an apparatus for imagewise transfer of the colorants into the polymer image-receiving layer 17. A flash system 43 illuminates a mask 45, which imagewise discriminates the impinging radiation 47 onto the colorant donor element 7. The mask 45 can be, but is not limited to, chromium on glass such as is common in the art. The colorant donor element 7 has peaks 9 and valleys 11 such that pressing the colorant donor element 7 against the mask 45 provides the space 15 between the colorant donor element 7 and the polymer image-receiving layer 17. Radiation 47 passes through transparent regions 49, in the mask 45, illuminates the colorant donor element 7, is absorbed in the colorant transfer layer, heats the donor imagewise, and causes colorant such a dye to transfer through the space 15 to the polymer image-receiving layer 17. Preferably, the same mask 45 can be used in the sequential process of forming different colored pixels. If it is used then of course it would have to moved laterally to form the next set of thermal pixels of a different color. See commonly-assigned U.S. Pat. No. 5,229,232 the disclosure of which is incorporated herein by reference.

Any material that absorbs the laser energy or high intensity light flash described above can be used as the absorbing material, for example, carbon black or non-volatile infrared-absorbing dyes or pigments which are well known to those skilled in the art. In a preferred embodiment, cyanine infrared absorbing dyes are employed as described in commonly-assigned U.S. Pat. No. 4,973,572, the disclosure of which is hereby incorporated by reference.

Irrespective of whether laser, flash lamps, or other radiation sources are employed to transfer the colorant from the donor to the image-receiving element, the intensity of the radiation should be high enough and the duration of the radiation should be short enough that there is no appreciable heating of the assembly with concomitant significant dimension change in the pattern of colorant. In this invention, the preferred duration of radiation is from 1 microsecond to 30 milliseconds. The preferred intensity of the radiation is from 0.01 Watts per square micrometer to 10 Watts per square micrometer.

The following example is provided to illustrate the invention.

EXAMPLE 1

Image-receiving elements were prepared by coating onto a 0.11 cm glass support an anisole solution of 11 wt % of the Receiver Polymer illustrated below resulting, after hot plate drying for 1 min at 60° C., in a 1.7 μm thick coating.

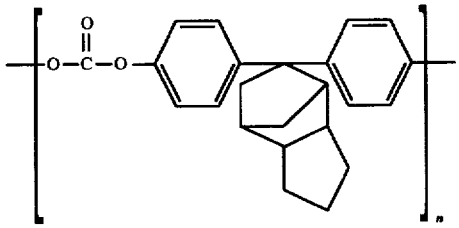

Receiver Polymer

Colorant donor elements were prepared by first coating onto 35 μm PET a layer comprising 0.26 g/m$^2$ magenta dye, M-1, illustrated above, 0.29 g/m$^2$ yellow dye, Y-3, illustrated above, 0.02 g/m$^2$ carbon black, 0.30 g/m$^2$ Butvar 76 (a poly(vinyl butyral) available from Monsanto Co.), and 0.005 g/m$^2$ Fluorad FC-431 (a perfluorinated surfactant available from 3M Corp.). After coating the colorant transfer layer, the colorant donor test elements of Table 1 were prepared by spin coating onto the back of the donor element support solutions of 5% cellulose acetate propionate (2.5% acetyl, 46% propionyl) binder in methyl ethyl ketone loaded with different levels of 4 μm and 12 μm cross-linked styrene-divinylbenzene-ethylstyrene beads (90% styrene content).

A 6.35 cm square chrome on quartz mask was held by 5.0 kN/m$^2$ of vacuum in a fixture. The pattern on the mask consisted of 188 transparent stripes 80 μm wide and 5.1 cm long each spaced 190 μm apart. Each of the colorant donor elements of Table 1 were placed on the mask with the bead coated side of the colorant donor element in contact with the mask. The colorant donor elements were pressed against the mask by evacuating a vacuum channel surrounding the mask to 5.0 kN/m$^2$ of vacuum, and the time to remove the air between the colorant donor element and the mask was recorded.

Image-receiving elements were placed in contact with the peaks on the colorant donor elements resulting from the coated beads. The colorant donor elements were exposed through the mask to a flash from an 800 volt flash lamp (EG&G, Salem, Mass., Model FXQ-254-6 lamp) to pattern-wise transfer the colorant from the colorant donor element to the image-receiving element. The imaged colorant donor element and image-receiving element were then separated and evaluated visually for uniformity. The following results were obtained:

TABLE 1

| Bead Diameter (μm) | Bead Surface Concentration (μ/mm$^2$) | Air Evacuation Time (sec) | Donor Uniformity | Receiver Unifomiity |
|---|---|---|---|---|
| 4 | 90 | 3 | Good | Good |
| 4 | 9* | 30 | Good | Good |
| 4 | 0.9* | 180 | Good | Good |
| 4 | 0.09* | >180** | Good | Good |
| 12 | 20 | <1 | Poor | Poor |
| 12 | 2* | 5 | Fair | Fair |
| 12 | 0.2* | 60 | Good | Fair |
| 12 | 0.02* | 90 | Good | Good |
| control | 0 | >180** | Poor | Poor |

*Estimated concentration based on dilution
**Trapped air removed after 180 sec by rubber roller The above results show that improved uniformity is obtained by small beads or moderate concentrations of larger beads compared to radiant colorant transfer without controlling the colorant donor element to image-receiving element spacing. The above results also show that pressing of the colorant donor element to the mask can be achieved without mechanical means by using a vacuum and a sufficient bead concentration.

The invention has been described in detail with particular reference to certain preferred embodiments thereof, but it will be understood that variations and modifications can be effected within the spirit and scope of the invention.

PARTS LIST

1 light emission
3 laser
5 lens or optical system
7 colorant donor element
**7*a*** rear surface of colorant donor element
9 peaks on color donor element
11 valleys on color donor element
13 transparent rigid element
15 space between colorant donor element and polymer image-receiving layer
17 polymer image-receiving layer
19 image-receiving support
**19*a*** image-receiving element
21 laser control unit
23 beads on colorant donor element
25 binder on colorant donor element
27 opaque rigid element
29 transparent support
31 color filter array
33 color cells or pixel cells
35 black grid lines
37 polymeric protective overcoat layer
39 transparent conducting layer
41 alignment layer
43 flash system
45 mask
47 radiation
49 transparent regions

We claim:

1. A method for producing a radiation-induced colorant transfer image, comprising the steps of:

a) providing an image-receiving element comprising a support having thereon an image-receiving layer;

b) providing a colorant donor element having a colorant transfer layer over a colorant element support and wherein colorant can be transferred from a transfer surface of the colorant donor element to the image-receiving layer in response to selectively applied radiation, and providing the colorant support element with a mixture of beads in a binder and wherein the beads form peak and valleys:

c) pressing the colorant element support surface against a rigid element so as to cause the colorant transfer layer surface to conformally have peaks and valleys;

d) causing the peaks of the colorant transfer layer to engage the image-receiving element; and e) applying radiation to the colorant donor element support to cause colorant to transfer in the space between the image-receiving element and the colorant transfer layer surface corresponding to the valleys in the colorant transfer surface.

2. The method of claim 1 wherein the beads are formed of cross-linked styrene-divinylbenzene-ethylstyrene.

3. The method of claim 1 wherein the beads provide peaks in a range of 3 to 50 μm above the colorant donor support surface and wherein the colorant donor support has a thickness in the range of about 6 to 100 μm.

4. The method of claim 1 wherein the beads provide peaks in a range of 3 to 12 μm above the colorant donor support surface and wherein the colorant donor support has a thickness in the range of about 6 to 50 μm.

* * * * *